US008897674B2

(12) United States Patent
Higaki

(10) Patent No.: US 8,897,674 B2
(45) Date of Patent: Nov. 25, 2014

(54) CHARGE MEMBER, CHARGE DEVICE AND IMAGE FORMING APPARATUS

(71) Applicant: Oki Data Corporation, Tokyo (JP)

(72) Inventor: Toshimasa Higaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 137 days.

(21) Appl. No.: 13/662,772

(22) Filed: Oct. 29, 2012

(65) Prior Publication Data

US 2013/0108325 A1 May 2, 2013

(30) Foreign Application Priority Data

Nov. 2, 2011 (JP) ..... 2011-241244

(51) Int. Cl.
*G03G 15/02* (2006.01)

(52) U.S. Cl.
CPC ..... *G03G 15/0233* (2013.01)
USPC ..... 399/176

(58) Field of Classification Search
CPC ..... G03G 15/0233
USPC ..... 399/176, 174
See application file for complete search history.

(56) References Cited

U.S. PATENT DOCUMENTS

| | | | | |
|---|---|---|---|---|
| 6,337,962 | B1 * | 1/2002 | Inoue et al. | 399/111 |
| 2008/0247778 | A1 * | 10/2008 | Motokawa et al. | 399/176 |
| 2011/0008070 | A1 * | 1/2011 | Sato | 399/176 |
| 2011/0129258 | A1 * | 6/2011 | Shin et al. | 399/176 |

FOREIGN PATENT DOCUMENTS

| | | | |
|---|---|---|---|
| JP | 2003-140439 | A | 5/2003 |
| JP | 2009-223214 | A | 10/2009 |

OTHER PUBLICATIONS

Machine translation of reference Higaki (JP 2009-223,214 A), Pub Date Oct. 1, 2009.*

* cited by examiner

*Primary Examiner* — Walter L Lindsay, Jr.
*Assistant Examiner* — Rodney Bonnette
(74) *Attorney, Agent, or Firm* — Muncy, Geissler, Olds & Lowe, P.C.

(57) ABSTRACT

A charge member is positioned in contact with an image carrier and charges a surface of the image carrier. The charge member includes a support body, an elastic layer having conductivity, which is formed on the support body; and a first surface treatment layer, which contains isocyanate compound and polycarbonate compound, is formed on the elastic layer. Residual potential of the charge member in 0.1 [seconds] after corona discharge at a voltage of 6.0 [kV] is 12.16 [V] or less.

13 Claims, 10 Drawing Sheets

CHARGE MEMBER, CHARGE DEVICE AND IMAGE FORMING APPARATUS

CROSS REFERENCE TO RELATED APPLICATION

The present application is related to, claims priority from and incorporates by reference Japanese Patent Application No. 2011-241244, filed on Nov. 2, 2011.

TECHNICAL FIELD

The present invention relates to a charge member, a charge device and an image forming apparatus.

BACKGROUND

In a conventional electrographic image forming apparatus, such as printers, photocopy machines, facsimile machines, multifunctional peripherals and the like (e.g., printer here as an example), a photosensitive drum, a charge device, a light emitting diode (LED) head, a development unit, a transfer roller, a cleaning device, a fuser and the like are arranged. An electrostatic latent image is formed by exposing, using the LED head, a surface of the photosensitive drum that has been uniformly charged by the charge device. The electrostatic latent image is developed by the development unit to form a toner image on the surface of the photosensitive drum. Then, the toner image is transferred to a sheet by the transfer roller and fixed onto the sheet at the fuser. In addition, the toner remained on the surface of the photosensitive drum after the transfer is removed by the cleaning device.

Among charge devices, a contact charge type charge device includes a charge roller as a charge member arranged to contact the photosensitive drum, a power source that applies a voltage to the charge roller, and the like. In the contact charge type charge device, the charge roller contacts the photosensitive drum. Therefore, image quality is decreased if foreign matter, such as the toner, external additive or the like that is not removed by the cleaning device, is attached to the charge roller, preventing the photosensitive drum from being appropriately charged, or if the foreign matter attached to the charge roller is attached to the photosensitive drum, causing the surface of the photosensitive drum to be smudged.

Therefore, a surface treatment using isocyanate and polycarbonate is performed on the surface of the charge roller to harden the surface and to increase release property. As a result, the foreign matter is suppressed from attached to the surface (see JP Laid-Open Patent Application No. 2009-223214, for example).

However, with the conventional charge roller, if the operator's hand touches the surface of the charge roller, for example, while transporting, inspecting or installing the charge roller in the printer, a touch mark is left on the charge roller. As a result, spots appear at the time of forming a halftone image and the like, causing the image quality to be decreased.

One of objects of the present invention is to solve the problems of the conventional charge roller and to provide a charge member, a charge device and an image forming apparatus that prevent the image quality from decreasing.

SUMMARY

For the objects, the charge member is arranged to contact an image carrier and to charge a surface of the image carrier.

Further, the charge member includes a support part and an elastic layer having conductivity, which is formed on the support part.

Further, a surface treatment layer (first surface treatment layer), which includes isocyanate compound and polycarbonate compound, is formed on the elastic layer.

As a result, residual potential after 0.1 [sec] when corona discharge is performed at a voltage of 6.0 [kV] is 12.16 [V] or less.

In another view of the invention, a charge member that is positioned in contact with an image carrier and that charges a surface of the image carrier, includes a support part, an elastic layer having conductivity, which is formed on the support part, and a first surface treatment layer, which contains isocyanate compound, polycarbonate compound and fluorine-based resin composition, is formed on the elastic layer. Wherein residual potential of the charge member in 0.1 [seconds] after corona discharge at a voltage of 6.0 [kV] is 12.29 [V] or less.

With this above structure, even if the operator's hand touches the surface of the charge roller, for example, while transporting, inspecting or installing the charge roller in the image forming apparatus, a touch mark is suppressed from being left on the charge roller.

Therefore, spots are suppressed from appearing at the time of forming a halftone image and the like, preventing the image quality from being decreased. Moreover, the charge member is easily handled.

DETAILED DESCRIPTION OF EMBODIMENTS

Embodiments of the present invention are explained in detail below with reference to the drawings. In this case, an electrographic printer is explained as an image forming apparatus.

Figure 2:
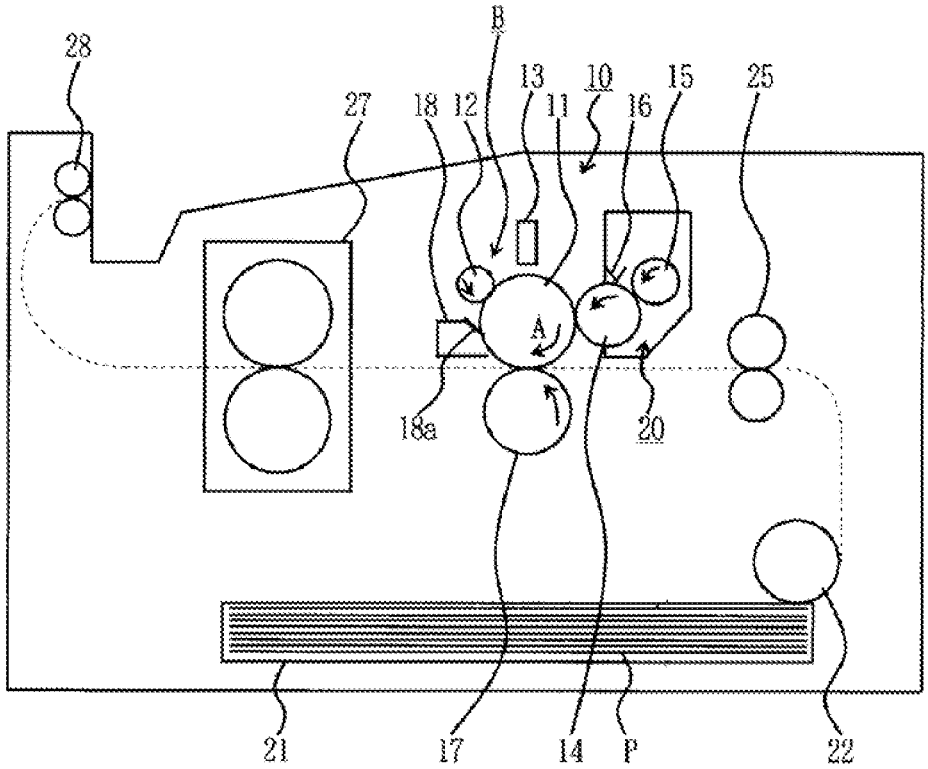
FIG. 2 is a schematic diagram of a printer according to the first embodiment of the present invention.

FIG. 2 is a schematic diagram of a printer according to a first embodiment of the present invention.

FIG. 2 shows an image forming unit 10, an exposure device 13, and a transfer device 17. The image forming unit 10 includes a photosensitive body (e.g., photosensitive drum 11) as an image carrier, a charge device B, a development unit 20, a cleaning device 18 and the like.

The charge device B includes a charge roller 12 as a charge member. The charge device B is arranged in contact with, or adjacent to, the photosensitive drum 11 and uniformly charges a surface of the photosensitive drum 11.

The development unit 20 includes a development roller 14 as a developer carrier, a development blade 16 as a developer layer regulation member, and the like. The development roller 14 is arranged in contact with, or adjacent to, the photosensitive drum 11 and forms a toner image as a developer image by attaching toner as a developer onto an electrostatic latent image as a latent image formed on the surface of the photosensitive drum 11. In addition, the development blade 16 is arranged in contact with, or adjacent to, the development roller 14 and forms a thin layer of the toner with an even thickness on the development roller 14.

The development roller 14 includes a shaft formed from a conductive body in which, for example, electroless nickel plating is performed on a steel used stainless (SUM) material and an elastic layer formed on the shaft and from an elastic body having conductivity, in which a conductive agent is included in urethane or the like. The development blade 16 is formed with, for example, a plate-shape member composed from a stainless steel.

The exposure device 13 includes an LED head and is arranged to face the photosensitive drum 11. The exposure device 13 exposes the surface of the photosensitive drum 11 and forms the electrostatic latent image on the surface of the photosensitive drum 11. The LED head is formed by LED elements, LED drive elements and a lens array.

The transfer device 17 includes a transfer roller as a transfer member. The transfer device 17 is arranged in contact with the photosensitive drum 11 and transfers the toner image formed on the surface of the photosensitive drum 11 onto a sheet P as a medium. The transfer roller includes a shaft formed from a conductive body that is formed by plating electroless nickel plating on a SUM material, for example, and an elastic layer formed on the shaft and from an elastic body having conductivity, such as epichlorohydrin rubber.

The cleaning device 18 includes a cleaning blade 18*a* as a cleaning member. The cleaning device 18 is arranged in contact with the photosensitive drum 11 and scrapes off the toner, dirt and the like attached on the photosensitive drum 11. The cleaning blade 18*a* is formed by, for example, a rubber blade formed from urethane and the like.

Under the image forming unit 10, a sheet cassette 21 as a medium accommodation part that accommodates the sheet P, and a hopping roller 22 as a feeding roller that separates and transfers each sheet P. On the downstream side of the hopping roller 22 in a medium carrying path through which the sheet P is carried, a pair of registration rollers 25 as carrying members are arranged for supplying the sheet P to a transfer part between the photosensitive drum 11 and the transfer roller. In addition, on the downstream side of the image forming unit 10 in the medium carrying path, a fuser 27 as a fuser device and a pair of ejection rollers 28 for ejecting the sheet P that has passed the fuser 27 outside a main body of the printer, that is, outside the device main body.

At the fuser 27, the toner image transferred onto the sheet P is heated and pressed to be fixed on the sheet P.

The photosensitive drum 11 is rotated in arrow A direction by driving a drive motor (not shown). The charge roller 12, the development roller 14, a toner supply roller 15 as a developer supply member, and a transfer roller are rotated in a direction opposite from the arrow A direction.

Two or more (e.g. four) image forming units 10 may be arranged along the medium carrying path. By forming toner images in different colors (e.g., black, yellow, magenta and cyan) using the respective image forming units 10, a color image is formed. In addition, the image forming unit 10 having white toner may be arranged to form white characters on a colored sheet, or the image forming unit 10 having transparent toner may be arranged to form a glossy image.

Next, operation of the printer having the above-described configuration is explained.

Each sheet P accommodated in the sheet cassette 21 is separated and fed by the hopping roller 22 and carried along the medium carrying path. Then, the sheet P passes through the transfer part after skew is corrected by the registration rollers 25, and the toner image on the photosensitive drum 11 is transferred onto the sheet P. The sheet P on which the toner image has been transferred to is sent to the fuser 27. At the fuser 27, the toner image is heated and pressed to be fixed on the sheet P. The sheet P is thereafter ejected outside the device main body by the ejection rollers 28.

Next, the photosensitive drum 11 is explained.

In the present embodiment, the photosensitive drum 11 includes a support body (not shown) made of a conductive material, such as aluminum, stainless steel and the like, an electric charge generation layer (not shown) formed on the support body and including an electric charge generation substance and a binder resin as main components, and an electric charge transportation layer (not shown) formed on the electric charge generation layer and including an electric charge transportation substance and the binder resin as main components. A layered structure is formed by the support body, the electric charge generation layer and the electric charge transportation layer.

As the electric charge generation substance, various organic pigment, dye and the like (micro particles thereof) may be used. As the organic pigment, azo pigment, such as phthalocyanine derivatives, monoazo, bisazo, trisazo, poly azo derivatives, in which metal, such as non-metal phthalocyanine, copper indium chloride, gallium chloride, tin, oxytitanium, zinc and vanadium, or metal oxide or metal chloride thereof, is coordinated, may be used. A dispersion layer is formed by binding the electric charge generation substance with various binder resins, such as polyester resin, polyvinyl acetate, polyacrylic ester, polymethacrylic acid ester, polyester, polycarbonate, polyvinyl acetoacetal, polyvinyl propional, polyvinyl butyral, phenoxy resin, epoxy resin, urethane resin, cellulose ester, cellulose ether and the like.

In addition, as the electric charge transportation substance, an electron donating substance, such as polymer having, as a main chain or a side chain, a heterocyclic compound (e.g., carbazole, indole, imidazole, oxazole, pyrazole, oxadiazole, pyrazoline, thiadiazole and the like), an aniline derivative, a hydrazone compound, an aromatic amine derivative, a stilbene derivative, or a substituent formed by these compounds, may be used. As the binder resin for the electric charge transportation layer, one or mixed ones of polycarbonate, polymethylmethacrylate, polystylene, vinyl polymer such as polyvinyl chloride, polyester, polyester carbonate, polysulfone, polyimide, phenoxy, epoxy, silicone, copolymer thereof, a partial cross-linked hardened material, and the like, may be used. In particular, polycarbonate is preferably used. In addition, as needed, various additives, such as antioxidant, sensitizer and the like, may be added.

Next, the charge device B is explained.

Figure 3:
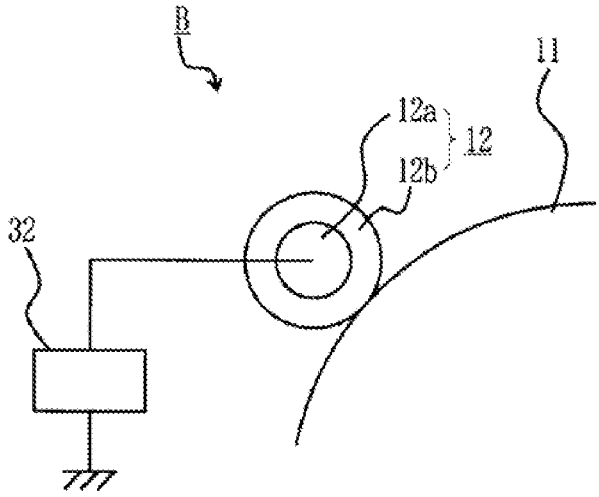
FIG. 3 is a schematic diagram of a charge device according to the first embodiment of the present invention.

FIG. 3 is a schematic diagram of the charge device according to the first embodiment of the present invention.

The charge device B includes the charge roller 12 and a charge power source 32 as a power source for charging to apply a voltage to the charge roller 12, and the like. The charge roller 12 includes a core 12*a* as a support part, and a conductive elastic layer 12*b* (or elastic layer having conductivity) formed on the core 12*a*. A surface treatment layer (not shown) is formed on the surface of the elastic layer 12*b*. When a voltage is applied to the core 12*a* by the charge power source 32, the surface of the photosensitive drum 11 is uniformly charged. A cleaning member may be arranged to remove the foreign matter, such as toner, external additive and the like, attached to the surface of the charge roller 12.

Next, the charge roller 12 is explained.

Figure 1:
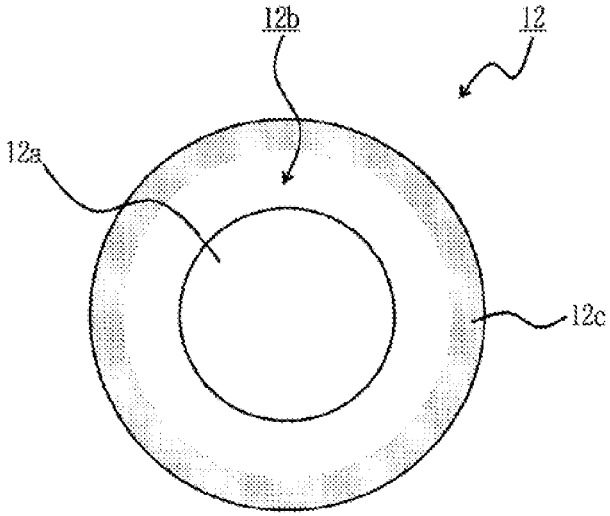
FIG. 1 is a cross-sectional view of a charge roller according to a first embodiment of the present invention.

FIG. 1 is a cross-sectional view of the charge roller according to the first embodiment of the present invention.

As shown FIG. 1, the charge roller 12 includes the core 12*a* formed from a conductive material, and the conductive elastic layer 12*b* formed at a part on the core 12*a* excluding both end parts.

As the core 12*a*, a metal shaft body, such as steel like Steel Use Machinerbility (SUM) or stainless steel like SUS, on a surface of which electroless nickel plating is treated, may be used. In addition, as the elastic layer 12*b*, an elastic body (e.g., rubber, thermoplastic elastomer, and resin in the present embodiment) may be used to form a predetermined nip with the photosensitive drum 11.

As the rubber, a rubber composition including one or mixed ones of epichlorohydrin rubber (CO, ECO, GECO), ethylene propylene rubber (EPM, EPDM), nitrile rubber (NBR), chloroprene rubber (CR), urethane rubber, silicone gum and the like) as a main component, may be used, for example. In particular, epichlorohydrin rubber (ECO) is preferably the main component.

The elastic layer 12*b* is formed as a resistance layer. In general, if a resistance value of the elastic layer 12 is larger, image defects occur due to uneven or insufficient charging on the surface of the photosensitive drum 11. On the other hand, if the resistance value is small, a current leak occurs due to scratch or the like on the surface of the photosensitive drum 11, causing the image defects to occur. Therefore, the elastic layer 12*b* needs to be formed so that the resistance value falls within a proper resistance range.

As such, in the present embodiment, the conductivity is provided by adding an ion conductive material, such as ion conductive agent, carbon black, metallic oxide and the like, to the elastic layer 12*b* so that the resistance value falls within the appropriate resistance value. To provide the conductivity, either electron conductivity or ion conductivity may be provided. However, because uneven resistance values of the elastic layer 12*b* cause uneven charging to occur on the surface of the photosensitive drum 11, it is preferable to provide the ion conductivity, rather than the electron conductivity, to suppress the uneven resistance values to occur.

In the present embodiment, the resistance value of the elastic layer 12*b* is $10^6$ [Ω] or more and $10^{10}$ [Ω] or less, and more preferably, $10^6$ [Ω] or more and $10^9$ [Ω] or less.

In the present embodiment, the elastic layer 12*b* has a single layer configuration. However, the elastic layer 12*b* may have a layered configure with two or more layers to adjust the resistance value of the elastic layer 12*b*.

Between the surface of the charge roller 12 and the surface of the photosensitive drum 11, a minute gap needs to be formed to secure a region to allow discharging based on Paschen's law. In the present embodiment, a nip is formed with excellent precision between the charge roller 12 and the photosensitive drum 11 by adjusting the hardness of the elastic layer 12*b*.

In the present embodiment, the hardness of the elastic layer 12*b* is measured by performing a peak measurement using a micro durometer MD-lcapa (Type A) (by Kobunshi Keiki Co., Ltd.). In this case, the hardness is preferably set in a range of 35 [degrees] or more and 80 [degrees] or less. The range of the hardness is also set to suppress effects due to vibration of the photosensitive drum 11 and the charge roller 12, fluctuation of shapes of the photosensitive drum 11 and the charge roller 12, and the like. Therefore, it is not necessary that the hardness is set within the above-described range as long as an appropriate nip is formed between the photosensitive drum 11 and the charge roller 12. On the outer surface of the elastic layer 12*b*, predetermined polishing marks are formed at predetermined surface roughness by trimming or polishing (tape polishing). The surface roughness may be adjusted depending on wet type polishing or dry type polishing, or by changing polishing conditions, such as a type of a grind stone, polishing speed, a type of the tape, pressure of the tape and the like.

In the present embodiment, the surface treatment layer 12*c* is formed by performing a surface treatment, coating and the like on the surface of the trimmed or polished elastic layer 12*b*. By forming the surface treatment layer 12*c*, the resistance value of the elastic layer 12*b* is adjusted. In addition, because the release property increases as the surface of the charge roller 12 is hardened, not only the attachment of the foreign matter to the charge roller 12 is suppressed, but also the attachment of the foreign matter to the surface of the photosensitive drum 11 is suppressed.

In this case, a surface treatment using isocyanate and polycarbonate is performed on the surface of the elastic layer 12*c*. Then, a surface treatment solution containing isocyanate compound and polycarbonate compound (polycarbonate-based polyol) is applied and penetrates the surface of the elastic layer 12*b*. As a result, the surface treatment layer 12*c* that contains isocyanate compound and polycarbonate compound is formed on the surface of the elastic layer 12*b*. The surface treatment layer 12*c* is one embodiment of the first surface treatment layer of the invention.

A coating treatment by dipping, spraying and the like may be used as the method to apply and cause the surface treatment solution to penetrate the surface of the elastic layer. In the present embodiment, the surface treatment solution is applied and caused to penetrate the surface of the elastic layer by performing the coating treatment by dipping.

Because the surface treatment solution penetrates the surface of the elastic layer 12*b*, there is no boundary surface between the elastic layer 12*b* and the surface treatment layer 12*c*.

Moreover, the surface treatment solution is made by dissolving isocyanate compound and polycarbonate compound in an organic solvent. Further, polyester-based polyol, polycarbonate-based polyol, silicone-based diol, acrylic silicone-based polymer and the like may be added, or a conductive agent, such as carbon black, may be added. Ethyl acetate, butyl acetate, xylene and the like may be used as the organic solution.

As the isocyanate compound, toluene diisocyanate (TDI), methylene diisocyanate (MDI), xylylene diisocyanate (XDI), naphthalene diisocyanate (NDI), hexamethylene diisocyanate (HDI), isophorone diisocyanate (IPDI), multiple bonding thereof, modification thereof, and the like may be used. Those with a molecular weight of 600 or more and 12000 or less are preferably used, and more preferably, 700 or more and 3000 or less are used.

As the polycarbonate compound, those with a molecular weight of 600 or more and 12000 or less are preferably used, and more preferably, 700 or more and 3000 or less are used.

Preferable surface roughness of the charge roller 12 differs depending on the applied voltage, usage environment of the printer and the like. However, the maximum height Ry is preferably 4 [μm] or more and 40 [μm] or less based on the Paschen's law. In the present embodiment, the measurement for the surface roughness was performed using a detector PU-DJ2S of a surface roughness measuring instrument SE-3500 (by Kosaka Laboratory Ltd.) and based on the standard JIS B0601: 1994.

Next, the method for measuring the resistance value of the elastic member 12*b* is explained.

Figure 4:
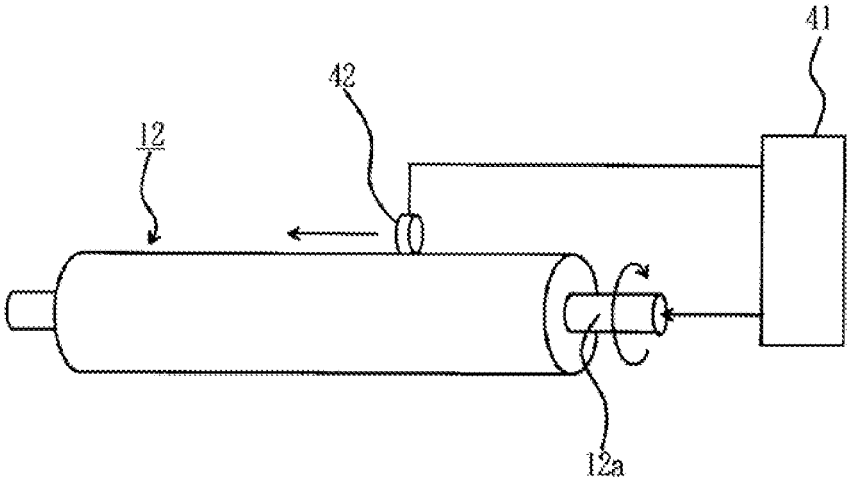
FIG. 4 illustrates a measurement method of a resistance value according to the first embodiment of the present invention.

FIG. 4 illustrates the measurement method of the resistance value according to the first embodiment of the present invention.

FIG. 4 shows the charge roller 12, the core 12*a*, a resistance measurement unit 41, and a bearing 42 as a pressure member. In the present embodiment, a high resistance meter 4339B (by Agilent Technologies, Inc.) is used as the resistance measurement unit 41. A ball bearing made of SUS having a width of 2.0 [mm] and a diameter of 6.0 [mm] is used as the bearing 42.

A predetermined direct current is applied between the bearing 42 and the core 12*a* by rotating the charge roller 12. By pressing the bearing 42 against the charge roller 12 at a force of 10 [gf] and sliding the bearing 42 in the arrow direction, the resistance value is measured. The resistance value of the charge roller 12 in general changes when the temperature, humidity, measurement voltage and the like change. In the present embodiment, a direct current voltage of −500 [V] is applied as the measurement voltage between the bearing 42 and the core 12*a* under an environment at the temperature of 20 [° C.] and the relative humidity of 50 [%].

For the charge roller 12 on which the surface treatment layer 12*c* containing isocyanate compound and polycarbonate compound is formed, if the operator's hand touches the surface of the charge roller 12, for example, while transporting, inspecting or installing the charge roller 12 in the printer, a touch mark is left. As a result, spots appear at the time of forming an image in halftone and the like, causing the image quality to be decreased. The touch mark is difficult to confirm with visual observation of the surface of the charge roller 12. Therefore, there is a problem that the touch mark cannot be identified unless the printing is performed after installation in the printer.

Thus, it is preferable to form the charge roller 12 with which a touch mark does not affect the image even if the operator's hand touch the surface of the charge roller 12 and if the touch mark is left.

In addition, the touch mark on the surface of the charge roller 12 occurs as the resistance value of the surface of the charge roller 12 is changed by touching. Therefore, the resistance value of the surface of the charge roller 12 needs to be measured. However, the measurement is extremely difficult because the resistance value of the surface of the charge roller 12 changes depending on multiplex causes of the resistance value, hardness, surface shape, thickness of the surface layer and the like of the elastic layer 12*b*.

As such, in the present embodiment, by measuring residual potential on the surface of the charge roller 12 after corona discharge and by forming a charge roller which residual potential is at a predetermined value or lower, the image is not affected by the touch mark even if the touch mark is left as the operator's hand touches the surface of the charge roller.

In other words, in the present embodiment, the charge roller 12 is used on which the residual potential after corona discharge is at the predetermined value or lower.

Next, the measurement method of the residual potential after performing the corona discharge on the charge roller 12 is explained.

Figure 5:
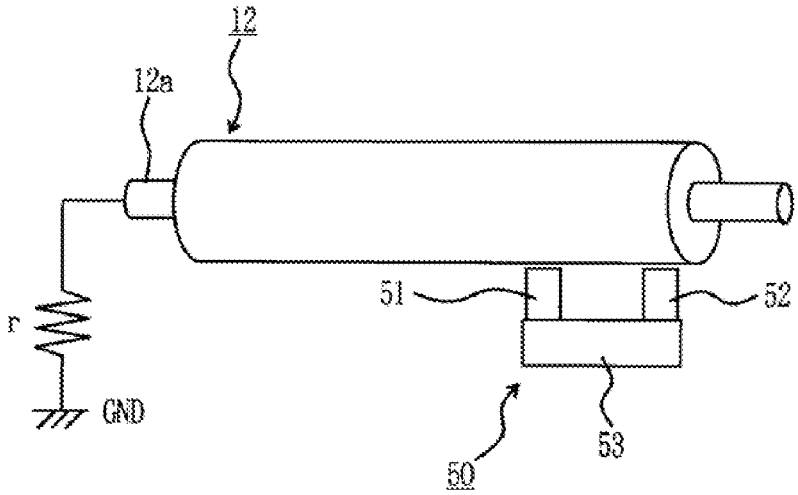
FIG. 5 illustrates a measurement method of residual potential according to the first embodiment of the present invention.

FIG. 5 illustrates the measurement method of residual potential according to the first embodiment of the present invention.

FIG. 5 shows the charge roller 12, the core 12*a*, and the residual potential measurement unit 50. Symbol r is a resister connected between the core 12*a* and the ground GND. The residual potential measurement unit 50 includes a carrier 53, a corona discharge terminal 51 provided on the carrier 53 and a probe 52 that is an electrometer. There is a predetermined space (23 [mm] in the present embodiment) between the corona discharge terminal 51 and the probe 52. Moreover, in the present embodiment, a dielectric relaxation measurement unit DRA-2000L (by Quality Engineering Associates) is used as the residual potential measurement device 50.

The core 12*a* is connected to the ground GND through the resister r of 1.0 [Me]. The voltage of the corona discharge by the corona discharge terminal 51 is set to 6.0 [kV]. The carrier 53 is moved along the axial direction of the charge roller 12 at a speed of 230 [mm/s]. The residual potential after a predetermined amount of time (0.1 [sec] in the present embodiment) is measured by using the probe 52. If the voltage of the corona discharge is less than 6.0 [kV], the value of the residual potential decreases, causing the measurement accuracy is reduced.

Next, examples of the embodiment and comparative examples are explained.

The elastic layer 12*b* is used as a rubber in the examples of the embodiment and the comparative examples. In this case, to form the charge roller 12, a rubber tune is formed by kneading the rubber, extruding the rubber in a tube shape and performing a primary vulcanization. Then, the rubber tube is press-fit on the core 12*a*, and the surface is treated by a dry polishing performed after performing the secondary vulcanization. The charge roller 12 of the examples of the embodiment and the comparative examples may be formed by other methods.

First Example

The outer diameter of the core 12*a* of the charge roller 12 is 6 [mm] The outer diameter of the elastic layer 12*b* is 12 [mm] The dry polishing using a grind stone is performed on the surface of the charge roller 12. The maximum height Ry of the surface roughness is about 13 [μm], and an average space Sm of the roughness is about 120 [μm].

For the elastic layer 12*b*, a rubber elastic body formed by mixing 100 [parts by weight] of epichlorohydrin rubber and 100 [parts by weight] of chloroprene rubber, which are the main components. The resistance value of the elastic layer 12*b* is $1\times10^7$ [Ω], and the hardness of the elastic layer 12*b* is 63 [degrees].

To perform the surface treatment on the elastic layer 12*b*, the elastic layer 12*b* is heated in an oven to volatile the organic solvent after dipping in the surface treatment solution. For the surface treatment solution, ethyl acetate is used as the organic solvent, and 20 [parts by weight] of hexamethylene diisocyanate (HDI) (molecular weight: about 1000) and 4 [parts by weight] of polycarbonate compound (polycarbonate-based polyol) (molecular weight: about 1200) are mixed in 100 [parts by weight] of ethyl acetate. Then, the mixture is agitated by a ball mill for 1 [hour]. At this time, the viscosity of the surface treatment solution is 1.25 [mPa·s] as measured by using a vibration type viscometer. For the dipping into the surface treatment solution, the dipping time is about 60 [sec], and a speed to remove the elastic layer 12*b* from a container containing the surface treatment solution, that is, removal speed is 100 [mm/s].

The residual potential of the charge roller 12 as obtained above after corona discharge is 9.76 [V].

Second Example

The elastic layer 12*b* is formed in a similar manner as the first example of the embodiment, and the same surface treatment solution as the first example of the embodiment is used to perform the surface treatment.

For the dipping into the surface treatment solution, the dipping time is 60 [sec], and the removal speed is 130 [mm/s].

The residual potential of the charge roller 12 as obtained above after corona discharge is 11.53 [V].

First Comparative Example

The elastic layer 12*b* is formed in a similar manner as the first example of the embodiment, and the same surface treatment solution as the first example of the embodiment is used to perform the surface treatment.

For the dipping into the surface treatment solution, the dipping time is 60 [sec], and the removal speed is 180 [mm/s].

The residual potential of the charge roller 12 as obtained above after corona discharge is 13.82 [V].

Third Example

The elastic layer 12*b* is formed in a similar manner as the first example of the embodiment, and the same surface treatment solution as the first example of the embodiment is used to perform the surface treatment.

For the dipping into the surface treatment solution, the dipping time is 30 [sec], and the removal speed is 75 [mm/s].

The residual potential of the charge roller 12 as obtained above after corona discharge is 5.39 [V].

Fourth Example

The elastic layer 12*b* is formed in a similar manner as the first example of the embodiment, and the surface treatment solution, which is created in the same manner as the first to third examples of the embodiment and the first comparative example and which is thereafter agitated by a ball mill for 5 [hours], is used to perform the surface treatment. The viscosity of the surface treatment solution at this time is 1.32 [mPa·s].

For the dipping into the surface treatment solution, the dipping time is 60 [sec], and the removal speed is 100 [mm/s].

The residual potential of the charge roller 12 as obtained above after corona discharge is 12.05 [V].

Second Comparative Example

The elastic layer 12*b* is formed in a similar manner as the first example of the embodiment, and the same surface treatment solution as the fourth example of the embodiment is used to perform the surface treatment.

For the dipping into the surface treatment solution, the dipping time is 60 [sec], and the removal speed is 130 [mm/s].

The residual potential of the charge roller 12 as obtained above after corona discharge is 15.01 [V].

Third Comparative Example

The elastic layer 12*b* is formed in a similar manner as the first example of the embodiment, and the surface treatment solution, which is created in the same manner as the fourth example of the embodiment and the second comparative example and which is thereafter agitated by a ball mill for 5 [hours], is used to perform the surface treatment. The viscosity of the surface treatment solution at this time is 1.43 [mPa·s].

For the dipping into the surface treatment solution, the dipping time is 60 [sec], and the removal speed is 100 [mm/s].

The residual potential of the charge roller 12 as obtained above after corona discharge is 15.60 [V].

Fifth Example

Similar to the first example of the embodiment, the elastic layer 12*b* is formed. To perform the surface treatment, for the surface treatment solution, ethyl acetate is used as the organic solvent, and 20 [parts by weight] of hexamethylene diisocyanate (HDI) (molecular weight: about 1000), 3 [parts by weight] of polycarbonate compound (polycarbonate-based polyol) (molecular weight: about 1200), and 2 [parts by weight] of carbon black (acetylene black) as the electron conductive agent are mixed in 100 [parts by weight] of ethyl acetate. Then, the mixture is agitated by a ball mill for 1 [hour]. The viscosity of the surface treatment solution at this time is 1.31 [mPa·s].

For the dipping into the surface treatment solution, the dipping time is about 60 [sec], and the removal speed is 100 [mm/s].

The residual potential of the charge roller 12 as obtained above after corona discharge is 8.48 [V].

Sixth Example

The elastic layer 12*b* is formed in a similar manner as the first example of the embodiment, and the same surface treatment solution as the fifth example of the embodiment is used to perform the surface treatment.

For the dipping into the surface treatment solution, the dipping time is about 30 [sec], and the removal speed is 75 [mm/s].

The residual potential of the charge roller 12 as obtained above after corona discharge is 4.35 [V].

Seventh Example

The elastic layer 12*b* is formed in a similar manner as the first example of the embodiment, and the surface treatment solution, which is created in the same manner as the fifth and sixth examples of the embodiment and which is thereafter agitated by a ball mill for 6 [hours], is used to perform the surface treatment. The viscosity of the surface treatment solution at this time is 1.46 [mPa·s].

For the dipping into the surface treatment solution, the dipping time is 60 [sec], and the removal speed is 100 [mm/s].

The residual potential of the charge roller 12 as obtained above after corona discharge is 12.16 [V].

Fourth Comparative Example

The elastic layer 12*b* is formed in a similar manner as the first example of the embodiment, and the same surface treatment solution as the seventh example of the embodiment is used to perform the surface treatment.

For the dipping into the surface treatment solution, the dipping time is 60 [sec], and the removal speed is 130 [mm/s].

The residual potential of the charge roller 12 as obtained above after corona discharge is 14.25 [V].

Next, the charge roller 12 of each of the first to seventh examples of the embodiment and the first to fourth comparative examples is installed in a printer and is evaluated based on a print result.

In this case, for the photosensitive drum 11, an aluminum tube which has an outer diameter of 30 [mm] and on a surface of which an alumite treatment is performed is used as a conductive support body. For the electric charge generation layer, phthalocyanine and polyvinyl acetoacetal-based resin are used as the electric charge generation substance and the binder resin, respectively. For the electric charge transportation layer, hydrazone-based compound and polycarbonate-based resin are used as the electric charge transportation substance and the binder resin, respectively. In addition, antioxidant is added. At this time, a film thickness of the electric charge transportation layer is 15 [μm].

Moreover, the charge roller 12 contacts the photosensitive drum 11 by being pressed on the surface of the photosensitive drum 11 as both end parts of the core 12*a* are pressed at a force of 400 [gf]. Therefore, the charge roller 12 is driven and rotates (follows to rotate) in accordance with the rotation of the photosensitive drum 11. Then, a direct current voltage of −1000 [V] is applied to the core 12*a* by the charge power source 32.

As another component of the printer, a commercial C711dn (by Oki Data Corporation) is used. As the sheet P, Excellent White (A4 size) (by Oki Data Corporation) is used. Moreover, as the print environment, the temperature and relative humidity are 23±2 [° C.] and 50±10 [%], respectively.

Next, a method for evaluating the charge roller 12 is explained.

In this case, on the surface of the charge roller 12 of the above-described first to seventh examples of the embodiment and the first to fourth comparative examples, a partial contact is performed under five different contact methods, and images of the parts that are in contact (hereinafter "contacted parts") and the parts that are not in contact (hereinafter "non-contacted parts") are compared.

The first contact method is a contact by fingers. The second contact method is wiping with ethanol. The third contact method is application of resin contact grease. The fourth contact method is application of metal contact grease. The fifth contact method is application of fluorine-based lubricant.

Wiping with ethanol under the second contact method is a method to soak the ethanol in a polyester cloth, to wipe the surface of the charge roller 12 with the cloth, and to volatilize the ethanol attached to the surface of the charge roller 12.

The application of the resin contact grease under the third contact method is a method to contain the resin contact grease in a brush, to stroke the surface of the charge roller 12 with the brush, and then to wipe the surface of the charge roller 12 with a dry cloth. In this case, MOLYKOTE® EM-30L (by Dow Corning Toray Co., Ltd.) is used as the resin contact grease. In the MOLYKOTE® EM-30L, as the main components, poly-a-olefin-based synthetic lubricant and, as thickener, lithium soap are contained in the base oil, respectively.

The application of the metal contact grease under the fourth contact method is a method to contain the metal contact grease in a brush, to stroke the surface of the charge roller 12 with the brush, and then to wipe the surface of the charge roller 12 with a dry cloth. In this case, C-5005 (by Tetra Co., Ltd.) is used as the resin contact grease. In the C-5005, as the main components, hydrocarbon oil and, as thickener, lithium soap are contained in the base oil, respectively.

The application of the fluorine-based lubricant under the fifth contact method is a method to contain the fluorine-based lubricant in a brush, to stroke the surface of the charge roller 12 with the brush, to wipe the surface of the charge roller 12 with a dry cloth, and then to volatilize the fluorine-based lubricant attached to the charge roller 12. Fluorine inclusion remains on the surface of the charge roller 12. In this case, Hanarl SF-0133 (by Kanto Kosei Co., Ltd.) is used as the fluorine-based lubricant. In Hanarl SF-0133, 80 to 90 [parts by weight] of volatile solvent and 10 to 20 [parts by weight] of polytetrafluoroethylene (PTFE) as fluorine oil and fluorine-based resin, and other components.

To compare the images, images having a 2-by-2 pattern at 600 [dpi], that is, a pattern in which 2×2 dots are formed at intervals of 2 dots, are formed. Then, images of the contact part and the non-contact part were compared using color difference ΔE. The color difference ΔE is measured by a spectrophotometer CM2600d (by Konica Milta Optics, Inc.).

The cooler difference ΔE is expressed by a CIE1976L*a*b* color system. A Distance of L*a*b* values obtained from the CIE1976L*a*b* color system is defined as the color difference. The color difference ΔE is $$\Delta E=(\Delta L^2+\Delta a^2+\Delta b^2)^{1/2}$$

when each difference of the L*a*b* values of the compared two colors is defined as ΔL, Δa and Δb, respectively.

An evaluation standard of the color difference ΔE is regulated by the National Bureau of Standards (NBS) unit and is categorized by "trace" (imperceptively observed) when the color difference ΔE is 0 or greater and less than 0.5, "slight" (slightly observed) when the color difference ΔE is 0.5 or greater and less than 1.5, "noticeable" (noticeably observed) when the color difference ΔE is 1.5 or greater and less than 3.0, "appreciable" (appreciably observed) when the color difference ΔE is 3.0 or greater and less than 6.0, and "much" (much observed) when the color difference ΔE is 6.0 or greater and less than 12, and "very much" (very much observed) when the color difference ΔE is 12 or greater.

Therefore, the smaller the color difference ΔE is, the less the image difference between the contact part and the non-contact part is, and the less obvious the touch mark is.

Figure 6:
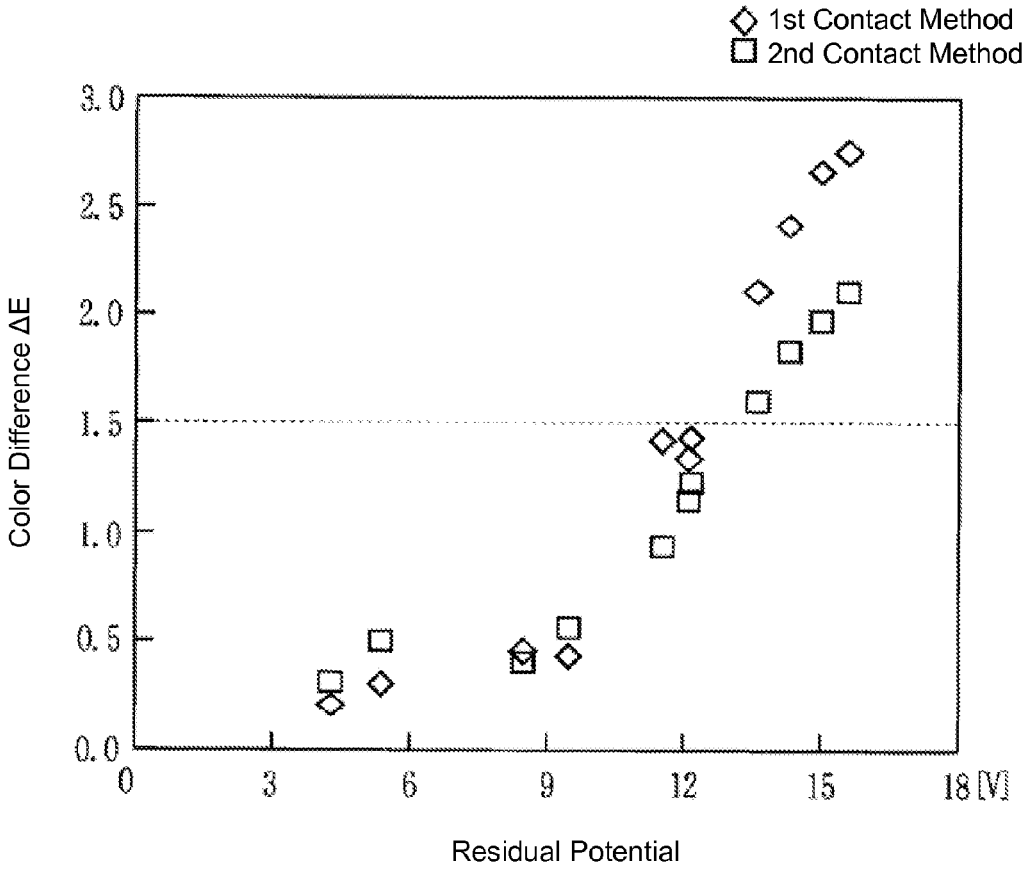
FIG. 6 illustrates a relationship between the residual potential and color difference for first and second contact methods according to the first embodiment of the present invention.
Figure 7:
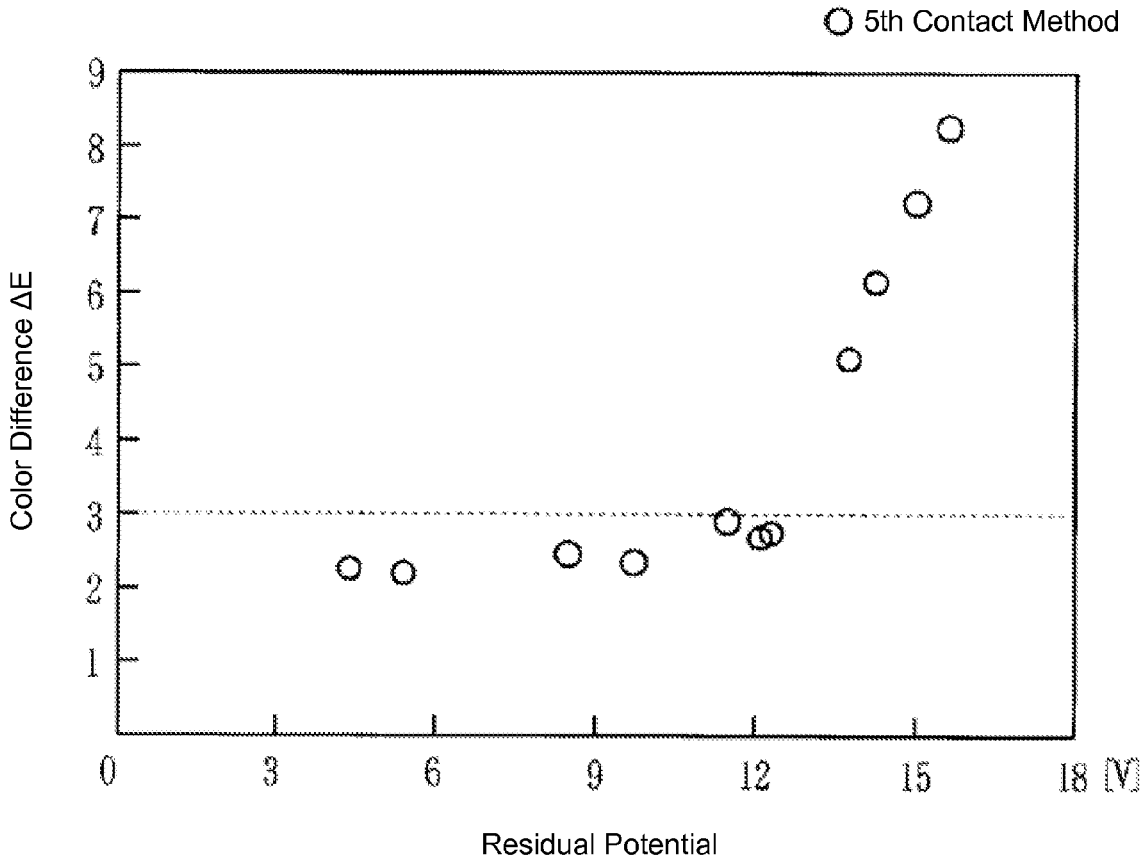
FIG. 7 illustrates a relationship between the residual potential and color difference for a fifth contact method according to the first embodiment of the present invention.

Next, the evaluation result of the charge roller 12 is explained based on Table 1 and FIGS. 6 and 7.

TABLE 1

| | | Color Difference ΔE | | | | |
|---|---|---|---|---|---|---|
| | Residual Potential [V] | 1st Contact Method | 2nd Contact Method | 3rd Contact Method | 4th Contact Method | 5th Contact Method |
| 1st Example | 9.76 | 0.42 | 0.57 | 0.33 | 0.52 | 2.36 |
| 2nd Example | 11.53 | 1.41 | 0.94 | 0.53 | 0.61 | 2.91 |
| 1st Comparative Example | 13.82 | 2.11 | 1.59 | 0.57 | 0.83 | 5.10 |
| 3rd Example | 5.39 | 0.30 | 0.49 | 0.34 | 0.69 | 2.19 |
| 4th Example | 12.05 | 1.34 | 1.15 | 0.47 | 0.95 | 2.70 |
| 2nd Comparative Example | 15.01 | 2.67 | 1.96 | 0.23 | 1.26 | 7.25 |
| 3rd Comparative Example | 15.60 | 2.76 | 2.11 | 0.49 | 1.41 | 8.27 |

TABLE 1-continued

| | Residual Potential [V] | Color Difference ΔE 1st Contact Method | 2nd Contact Method | 3rd Contact Method | 4th Contact Method | 5th Contact Method |
|---|---|---|---|---|---|---|
| 5th Example | 8.48 | 0.46 | 0.40 | 0.23 | 0.63 | 2.44 |
| 6th Example | 4.35 | 0.19 | 0.31 | 0.13 | 0.71 | 2.24 |
| 7th Example | 12.16 | 1.43 | 1.23 | 0.18 | 1.18 | 2.73 |
| 4th Comparative Example | 14.25 | 2.41 | 1.83 | 0.38 | 1.33 | 6.13 |

FIG. 6 illustrates a relationship between the residual potential and color difference for first and second contact methods according to the first embodiment of the present invention. FIG. 7 illustrates a relationship between the residual potential and color difference for a fifth contact method according to the first embodiment of the present invention. In the figures, the horizontal axis indicates the residual potential, and the vertical axis indicates the color difference ΔE.

It is understood from Table 1 and FIG. 6 that, in the first and second contact methods, the color difference ΔE increases rapidly when the residual potential increases, and the color difference ΔE decreases when the residual potential decreases. If the residual potential is 13.82 [V] or greater, the color difference ΔE becomes 1.5 or more. As a result, the touch mark becomes more noticeable, and the image quality is decreased.

In addition, if the residual potential is 12.16 [V] or less, the color difference ΔE becomes 1.5 or less. As a result, the touch mark becomes less noticeable (slightly observed), and decrease of the image quality is suppressed to an acceptable level.

Moreover, it is understood from Table 1 and FIG. 7 that, in the fifth contact method, the color difference ΔE rapidly increases when the residual potential increases, and the color difference ΔE decreases when the residual potential decreases, similar to the first and second contact methods. In the fifth contact method, the color difference ΔE is greater compared with the first to fourth contact methods. The color difference ΔE becomes 3.0 or less if the residual potential is 12.16 [V] or less. Further, if the residual potential is 13.82 [V] or greater, the value of the color difference ΔE becomes 3.0 or greater. As the color difference ΔE becomes extremely great, the contact trace becomes very noticeable. Therefore, by adjusting at least the residual potential to 12.16 [V] or less, the color difference ΔE is suppressed from increasing, thereby making the touch mark to be less noticeable.

It is understood from Table 1 that, in the third and fourth contact methods, the color difference ΔE becomes 1.5 or less even if the residual potential is 15.60 [v]. As a result, the contact trace becomes less noticeable (at a slightly observed level).

As discussed above, in the present embodiment, for the charge roller 12 in which the surface treatment layer 12*c* containing isocyanate compound and polycarbonate compound is formed, the color difference ΔE is suppressed from increasing if the residual potential is 12.16 [V] or less after 0.1 [seconds] when corona discharge is performed with a voltage of 6.0 [kV]. Therefore, even if the operator touches the surface of the charge roller 12 when transporting, inspecting and installing the charge roller 12 in the printer, the touch mark is suppressed from being left on the charge roller 12.

As a result, a phenomenon that spot marks are generated when a half-tone image and the like are formed is suppressed, and thereby preventing the image quality from being decreased. In addition, the charge roller 12 is easily handled.

Next, a second embodiment of the present invention is explained. Structures that are the same as those in the first embodiment are referenced by the same symbols. The effects of the invention resulting from such same structures are also applicable in the embodiment.

Figure 8:
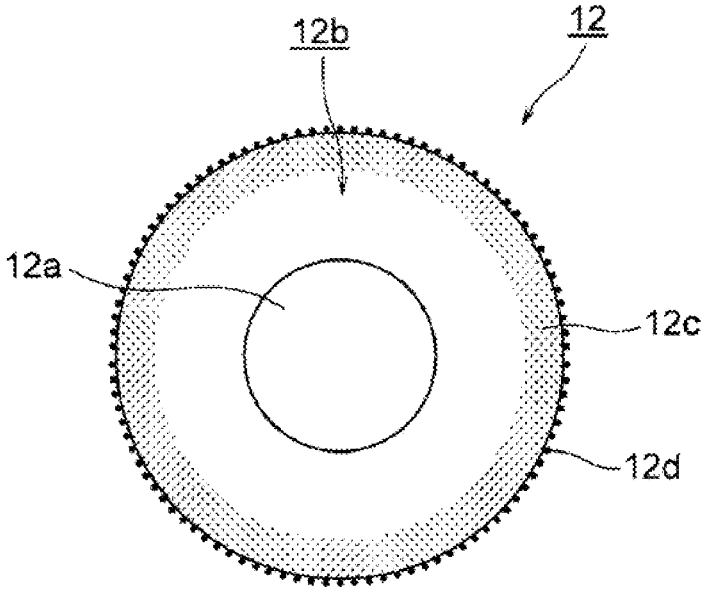
FIG. 8 is a cross-sectional view of the charge roller according to a second embodiment.
Figure 9:
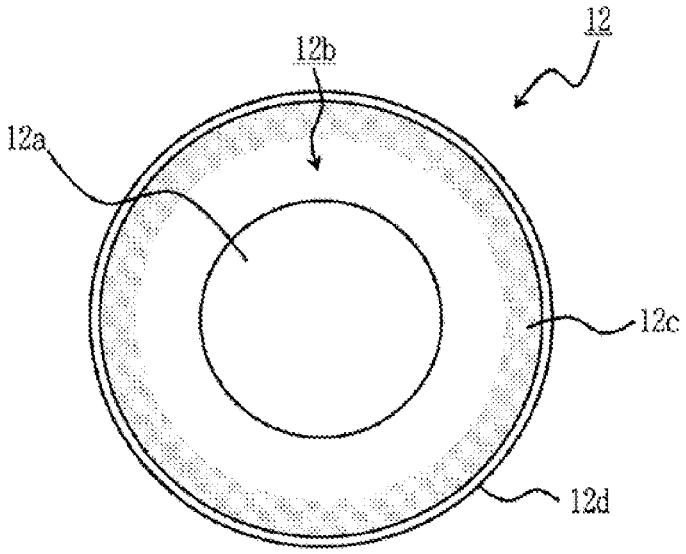
FIG. 9 is a cross-sectional view of another charge roller according to the second embodiment of the present invention.

FIG. 8 is a cross-sectional view of the charge roller according to a second embodiment. FIG. 9 is a cross-sectional view of another charge roller according to the second embodiment of the present invention.

In this case, the charge roller 12 as the charge member includes the core 12*a* as the support part formed from a conductive material and the conductive elastic layer 12*b* formed at a part on the core 12*a* excluding both end parts. The same surface treatment layer 12*c* as that in the first embodiment is formed on the surface of the elastic layer 12*b*.

In the present embodiment, as shown in FIG. 8, a surface treatment layer 12*d* (or second surface treatment layer) is formed by further applying fluorine-based resin such as polytetrafluoroethylene (PTFE) and the like to evenly scatter the fluorine-based resin on the outermost surface of the surface treatment layer 12*c*. Alternatively, as shown in FIG. 9, the surface treatment layer 12*d* is formed by coating the surface treatment layer 12*c* with the coat layer. Even in an embodiment disposing the second surface treatment layer on the surface, the first surface treatment layer may include fluorine-based resin. In this invention, the first surface treatment layer means an inner layer, the second surface treatment layer means an outer layer.

In addition, by performing the surface treatment on the surface of the elastic layer 12*b*, the surface treatment layer 12*c* containing isocyanate, polycarbonate and fluorine-based resin composition is formed. In this case, the surface treatment solution containing isocyanate, polycarbonate-based polyol and fluorine-based resin composition is applied on and penetrates the surface of the elastic layer 12*b*. Then, there is no boundary surface between the elastic layer 12*b* and the surface treatment layer 12*c*, and the fluorine-based resin scatters near the surface of the elastic layer 12*b*.

Next, examples of the embodiment and comparative examples are explained.

Eighth Example

The outer diameter of the core 12*a* of the charge roller 12 is 6 [mm] The outer diameter of the elastic layer 12*b* is 12 [mm] The dry polishing using a grind stone is performed on the surface of the charge roller 12. The maximum height Ry of the surface roughness is about 13 [μm], and an average space Sm of the roughness is about 120 [μm].

For the elastic layer 12*b*, a rubber elastic body formed by mixing 100 [parts by weight] of epichlorohydrin rubber and 100 [parts by weight] of chloroprene rubber, which are the main components. The resistance value of the elastic layer 12*b* is $1\times10^7$ [Ω], and the hardness of the elastic layer 12*b* is 63 [degrees].

To perform the surface treatment on the elastic layer 12*b*, the elastic layer 12*b* is heated in an oven to volatile the organic solvent after dipping in the surface treatment solution. For the surface treatment solution, ethyl acetate is used as the organic solvent, and 20 [parts by weight] of hexamethylene diisocyanate (HDI) (molecular weight: about 1000) and 4 [parts by weight] of polycarbonate compound (polycarbonate-based polyol) (molecular weight: about 1200) are mixed in 100 [parts by weight] of ethyl acetate. Then, the mixture is agitated by a ball mill for 1 [hour]. At this time, the viscosity of the surface treatment solution is 1.25 [mPa·s] as measured by using a vibration type viscometer.

For the dipping into the surface treatment solution, the dipping time is about 60 [sec], and the removal speed is 100 [mm/s].

Next, polytetrafluoroethylene (PTFE) is applied on the elastic layer 12*b* that has been surface treated, to form the charge roller 12.

The residual potential of the charge roller 12 as obtained above after corona discharge is 7.32 [V].

Ninth Example

Similar to the first example of the embodiment, the elastic layer 12*b* is formed. To perform the surface treatment, for the surface treatment solution, ethyl acetate is used as the organic solvent, and 20 [parts by weight] of hexamethylene diisocyanate (HDI) (molecular weight: about 1000), 3 [parts by weight] of polycarbonate compound (polycarbonate-based polyol) (molecular weight: about 1200), and 2 [parts by weight] of carbon black (acetylene black) as the electron conductive agent are mixed in 100 [parts by weight] of ethyl acetate. Then, the mixture is agitated by a ball mill for 1 [hour]. The viscosity of the surface treatment solution at this time is 1.32 [mPa·s].

For the dipping into the surface treatment solution, the dipping time is about 60 [sec], and the removal speed is 100 [mm/s].

Next, polytetrafluoroethylene (PTFE) is applied on the elastic layer 12*b* that has been surface treated, to form the charge roller 12.

The residual potential of the charge roller 12 as obtained above after corona discharge is 6.26 [V].

Tenth Example

The elastic layer 12*b* is formed in a similar manner as the first example of the embodiment, and the same surface treatment solution as the fourth example of the embodiment is used to perform the surface treatment.

For the dipping into the surface treatment solution, the dipping time is 60 [sec], and the removal speed is 130 [mm/s].

Next, polytetrafluoroethylene (PTFE) is applied on the elastic layer 12*b* that has been surface treated, to form the charge roller 12.

The residual potential of the charge roller 12 as obtained above after corona discharge is 12.29 [V].

Eleventh Example

The elastic layer 12*b* is formed in a similar manner as the first example of the embodiment, and the same surface treatment solution as the seventh example of the embodiment is used to perform the surface treatment.

For the dipping into the surface treatment solution, the dipping time is 60 [sec], and the removal speed is 130 [mm/s].

Next, polytetrafluoroethylene (PTFE) is applied on the elastic layer 12*b* that has been surface treated, to form the charge roller 12.

The residual potential of the charge roller 12 as obtained above after corona discharge is 11.96 [V].

Fifth Comparative Example

The elastic layer 12*b* is formed in a similar manner as the first example of the embodiment, and the same surface treatment solution as the seventh example of the embodiment is used to perform the surface treatment.

For the dipping into the surface treatment solution, the dipping time is 60 [sec], and the removal speed is 130 [mm/s].

Next, polytetrafluoroethylene (PTFE) is applied on the elastic layer 12*b* to form the charge roller 12, after heating the elastic layer for 1 [hour] under 150 [° C.] in an oven to volatile ethyl acetate.

The residual potential of the charge roller 12 as obtained above after corona discharge is 15.69 [V].

Sixth Comparative Example

The elastic layer 12*b* is formed in a similar manner as the first example of the embodiment, and the same surface treatment solution as the seventh example of the embodiment is used to perform the surface treatment.

For the dipping into the surface treatment solution, the dipping time is 60 [sec], and the removal speed is 180 [mm/s].

Next, polytetrafluoroethylene (PTFE) is applied on the elastic layer 12*b* to form the charge roller 12, after heating the elastic layer for 1 [hour] under 150 [° C.] in an oven to volatile ethyl acetate.

The residual potential of the charge roller 12 as obtained above after corona discharge is 13.98 [V].

Next, the charge roller 12 of each of the eighth to eleventh examples of the embodiment and the fifth and sixth comparative examples is installed in a printer and is evaluated based on a print result. The evaluation result of the charge roller 12 is explained based on Table 2 and FIG. 10.

TABLE 2

| | | Color Difference ΔE | | | | |
|---|---|---|---|---|---|---|
| | Residual Potential [V] | 1st Contact Method | 2nd Contact Method | 3rd Contact Method | 4th Contact Method | 5th Contact Method |
| 8th Example | 7.32 | 0.63 | 1.26 | 1.18 | 0.79 | 1.19 |
| 9th Example | 6.26 | 0.31 | 1.37 | 1.22 | 0.89 | 1.36 |
| 10th Example | 12.29 | 0.79 | 1.39 | 1.35 | 1.19 | 0.94 |
| 11th Example | 11.96 | 0.66 | 1.46 | 1.42 | 1.36 | 1.31 |
| 5th Comparative Example | 15.69 | 1.09 | 1.89 | 1.26 | 1.42 | 1.34 |
| 6th Comparative Example | 13.98 | 0.87 | 2.18 | 1.12 | 1.35 | 1.23 |

Figure 10:
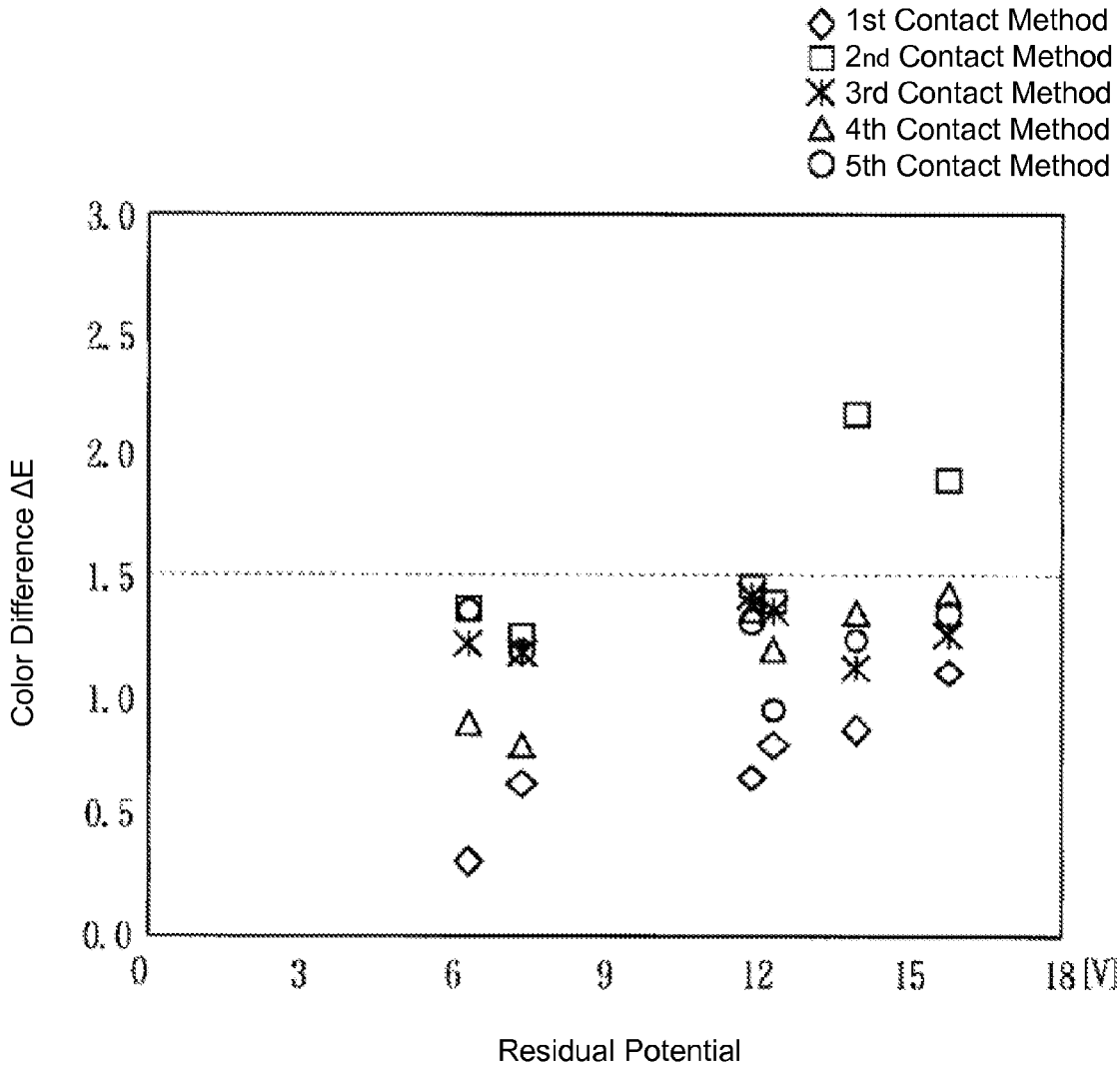
FIG. 10 illustrates a relationship between the residual potential and the color difference for the first to fifth contact methods according to the second embodiment of the present invention.

FIG. 10 illustrates a relationship between the residual potential and the color difference for the first to fifth contact methods according to the second embodiment of the present invention. In the figures, the horizontal axis indicates the residual potential, and the vertical axis indicates the color difference ΔE.

It is understood from Table 2 and FIG. 10 that, in the first, second and fourth contact methods, the color difference ΔE increases when the residual potential increases, and the color difference ΔE decreases when the residual potential decreases. That is, in the second contact method, if the residual potential is 13.98 [V] or greater, the color difference ΔE becomes 1.5 or more. As a result, the touch mark becomes more noticeable, and the image quality is decreased. In addition, if the residual potential is 0 [V] or greater and 12.29 [V] or less, the color difference ΔE becomes 1.5 or less. As a result, the touch mark becomes less noticeable. In the first and fourth contact methods, if the residual potential is 0 [V] or greater and 15.69 [V] or less, the color difference ΔE becomes 1.5 or less. As a result, the touch mark becomes less noticeable.

In the third and fifth contact methods, if the residual potential is 0 [V] or greater and 15.69 [V] or less, there is no interrelation between the residual potential and the color difference ΔE, and the color difference ΔE becomes 1.5 or less. As a result, the touch mark becomes less noticeable.

As discussed above, in the present embodiment, for the charge roller 12 in which the surface treatment layer 12*c* containing isocyanate compound, polycarbonate compound and fluorine-based resin composition is formed, the color difference ΔE is suppressed from increasing if the residual potential is 0 [V] or greater and 12.29 [V] or less after 0.1 [seconds] when corona discharge is performed with a voltage of 6.0 [kV]. Therefore, even if the operator touches the surface of the charge roller 12 when transporting, inspecting and installing the charge roller 12 in the printer, the touch mark is suppressed from being left on the charge roller 12.

As a result, a phenomenon that spot marks are generated when a half-tone image and the like are formed is suppressed, and thereby preventing the image quality from being decreased. In addition, the charge roller 12 is easily handled.

In each of the above-described embodiments, the charge roller that charges the surface of the photosensitive drum 11 as the image carrier is explained. However, the present invention may be applied to a charge roller, a charge drum and the like as charge members that charge a surface of an image carrier other than the photosensitive drum 11, such as a photosensitive belt or the like.

In addition, in each of the above-described embodiments, the elastic layer 12*b* has a single layer structure. However, the elastic layer may have a multiple layer structure.

The present embodiments are not limited to those described above, and various changes and modifications are available without departing from the scope of the invention.

What is claimed is:

1. A charge member that is positioned in contact with an image carrier and that charges a surface of the image carrier, comprising:

a support part;

an elastic layer having conductivity, which is formed on the support part; and a first surface treatment layer, which contains isocyanate compound and polycarbonate compound, is formed on the elastic layer, wherein residual potential of the charge member in 0.1 [seconds] after corona discharge at a voltage of 6.0 [kV] is 12.16 [V] or less.

2. The charge member according to claim 1, wherein the first surface treatment layer further contains carbon black.

3. The charge member according to claim 1, further comprising:

a second surface treatment layer containing fluorine-based resin composition, which is formed on the first surface treatment layer.

4. The charge member according to claim 1, wherein surface treatment solution for forming the first surface treatment layer contains isocyanate compound and polycarbonate compound.

5. The charge member according to claim 4, wherein surface treatment solution for forming the first surface treatment layer further contains fluorine-based resin composition so that the first surface treatment layer contains fluorine-based resin composition.

6. A charge member that is positioned in contact with an image carrier and that charges a surface of the image carrier, comprising:

a support part;

an elastic layer having conductivity, which is formed on the support part; and a first surface treatment layer, which contains isocyanate compound, polycarbonate compound and fluorine-based resin composition, is formed on the elastic layer, wherein residual potential of the charge member in 0.1 [seconds] after corona discharge at a voltage of 6.0 [kV] is 12.29 [V] or less.

7. The charge member according to claim 6, wherein the first surface treatment layer further contains carbon black.

8. The charge member according to claim 6, further comprising a second surface treatment layer containing fluorine-based resin composition, which is formed on the first surface treatment layer.

9. The charge member according to claim 6, wherein surface treatment solution for forming the surface treatment layer contains isocyanate compound, polycarbonate compound and fluorine-based resin composition.

10. A charge device, comprising:

a charge member that is positioned in contact with an image carrier and that charges a surface of the image carrier, wherein (a) the charge member includes a support part, and an elastic layer having conductivity, which is formed on the support part, (b) a surface treatment layer, which contains isocyanate compound and polycarbonate compound, is formed on the elastic layer, and (c) residual potential of the charge member in 0.1 [seconds] after corona discharge at a voltage of 6.0 [kV] is 12.16 [V] or less.

11. A charge device comprising a charge member that is positioned in contact with an image carrier and that charges a surface of the image carrier, wherein (a) the charge member includes a support part, and an elastic layer having conductivity, which is formed on the support part, (b) a surface treatment layer, which contains isocyanate compound, polycarbonate compound and fluorine-based resin composition, is formed on the elastic layer, and (c) residual potential of the charge member in 0.1 [seconds] after corona discharge at a voltage of 6.0 [kV] is 12.29 [V] or less.

12. An image forming apparatus, comprising:

a charge member that is positioned in contact with an image carrier and that charges a surface of the image carrier, wherein (a) the charge member includes a support part, and an elastic layer having conductivity, which is formed on the support part, (b) a surface treatment layer, which contains isocyanate compound and polycarbonate compound, is formed on the elastic layer, and (c) residual potential of the charge member in 0.1 [seconds] after corona discharge at a voltage of 6.0 [kV] is 12.16 [V] or less.

13. An image forming apparatus, comprising:

a charge member that is positioned in contact with an image carrier and that charges a surface of the image carrier, wherein (a) the charge member includes a support part, and an elastic layer having conductivity, which is formed on the support part, (b) a surface treatment layer, which contains isocyanate compound, polycarbonate compound and fluorine-based resin composition, is formed on the elastic layer, and (c) residual potential of the charge member in 0.1 [seconds] after corona discharge at a voltage of 6.0 [kV] is 12.29 [V] or less.

* * * * *